United States Patent [19]

Schiffmacher et al.

[11] 4,126,715

[45] Nov. 21, 1978

[54] METHOD AND APPARATUS FOR REINKING TYPING RIBBON CARTRIDGES

[75] Inventors: William M. Schiffmacher; J. Eugene Harold Knutson, both of Boulder, Colo.

[73] Assignee: United Recycle, Inc., Boulder, Colo.

[21] Appl. No.: 781,763

[22] Filed: Mar. 28, 1977

[51] Int. Cl.[2] ..... B41J 31/14

[52] U.S. Cl. ..... 427/141; 118/6; 118/235; 427/8; 400/197

[58] Field of Search ..... 427/141, 8; 197/171; 118/6, 235

[56] References Cited

U.S. PATENT DOCUMENTS

| | | | |
|---|---|---|---|
| 2,005,503 | 6/1935 | Pelton | 197/177 |
| 2,798,429 | 7/1957 | Werner et al. | 197/171 |
| 3,732,211 | 5/1973 | Anderson | 427/141 |
| 3,887,056 | 6/1975 | Lehmann | 197/171 |
| 3,977,512 | 8/1976 | Teagarden et al. | 197/171 |

*Primary Examiner*—Ronald H. Smith
*Assistant Examiner*—Janyce A. Bell
*Attorney, Agent, or Firm*—Sheridan, Ross, Fields & McIntosh

[57] ABSTRACT

Typing ribbons stored in cartridges are reinked by the use of an apparatus having a plurality of drive devices arranged to pull the ribbon through the reinking mechanism and return the ribbon to the cartridge without placing stress on the cartridge case or rewinding mechanism. The apparatus includes a bracket for securely mounting the cartridge with the ribbon threaded over a self-inking drum. A drive system is provided for rotating the inking drum and pulling the ribbon by a drive capstan to maintain a taut condition. A variable speed motor is included for returning the ribbon to the cartridge through its reloading mechanism. Sensors and an electrical control circuit are provided for automatically stopping the reinking process at its completion or if a defect in the ribbon is detected.

7 Claims, 5 Drawing Figures

METHOD AND APPARATUS FOR REINKING TYPING RIBBON CARTRIDGES

BACKGROUND OF THE INVENTION

This invention is directed to a method and apparatus for reinking typing ribbons for recycle and reuse. More specifically, it is directed to a device that is capable of automatically reinking typing ribbons stored in cartridges by use of a plurality of individual drive motors to effectively accomplish the reinking process.

Reinking of typing ribbons such as for use in typewriters or similar machines is well known in the prior art. Hernandez, in his U.S. Pat. No. 2,699,245, discloses the reinking of double spool typewriter ribbons. In this arrangement, the inventor provides a series of rollers for applying and distributing ink to the ribbon as it moves from one spool to the other during the typing process. The take-up spool in each case provides the only drive means for the ribbon placing an undue stress on the ribbon during the inking process which could cause stretch or breakage of the ribbon reducing its useful life.

In other patents which disclose reinking of cartridge type printing ribbons, the reinking device is usually provided within the cartridge with an external drive force applied to the cartridge rewinding mechanism. The reinking elements create a substantial drag and stress on the ribbon along with cartridge tensioning devices which can overload or stress the cartridge rewinding mechanism reducing its life expectancy.

Most of the typing cartridges which are presently on the market are of the disposable type and contain a rewinding or reloading mechanism which is extremely fragile and designed for short life during the one time use of the cartridge. The attempt to reink this type of cartridge, by the existing methods usually causes breakage which negates any possible savings. Thus, it is desirable to provide an apparatus which isolates the cartridge rewind mechanism from the actual ribbon reinking and transfers the ink efficiently to the ribbon with a minimum of stress.

The cartridge which contains an endless, typing ribbon is typical of the typing cartridges presently on the market. These cartridges are primarily used in industrial applications, such as computers, teletype machines, telex machines and the like. Although the endless ribbon cartridge is illustrated and described in this specification, it is to be understood that the problems with reinking the various cartridge type ribbons are essentially the same and the invention is directed to the problems associated with all of these types.

In view of the problems and concerns stated above, an object of the present invention is to provide a machine for reinking cartridge type ribbons which allows the reuse of the cartridge until the ribbon itself is worn out.

Another object of the present invention is to provide a ribbon reinking apparatus which eliminates any undue stress on the ribbon or the cartridge mechanism which would damage either during the reinking process.

Another object of the present invention is to provide an apparatus which can be easily, quickly and inexpensively used to automatically reink the ribbon cartridges.

A still further object of the present invention is to provide a method by which the ribbon cartridge can be easily reinked with any defects in the reinked ribbon automatically detected.

SUMMARY OF THE INVENTION

The present invention includes a self supporting panel upon which the components of the reinking machine are mounted. A mounting bracket is provided for firmly supporting the ribbon cartridge. The ribbon is threaded from the outlet side of the cartridge over an inking drum, circuitously across a heat source and then around a drive capstan before returning to the inlet side of the cartridge.

Guide rollers are provided on either side of the ink drum for guiding the ribbon from the cartridge to the drum and from the drum to the heat source. An ink reservoir is provided below the drum with an inking wheel mounted in the reservoir in contact with the drum. A positive gear drive turns the inking wheel at the same circumferential velocity as the drum so there is no slippage between the two. As the inking wheel rotates in the reservoir it picks up a film of ink on its outer surface and transfers this ink evently to the surface of the drum. The drum is fabricated from a nonporous, rigid material such as aluminum with the inking wheel fabricated from or coated with a softer material, such as rubber or plastic. The spacing between the parallel shafts of the inking wheel and drum can be varied to change the compression force of the softer wheel against the drum to vary or change the thickness of the ink coating applied. Thus, it is a simple matter to vary the amount of ink that is applied to the ribbon. The woven nylon ribbon, which is illustrated herein, passes over the surface of the drum so that the ink is directly transferred to the ribbon.

The ribbon next passes over and under a pair of stationary elongated incandescent lamps which function as a source of heat. Due to their relatively high temperature, a major portion of the volatile solution in the ink is rapidly evaporated leaving the carbon black of the ink impregnated in the pores of the ribbon. Although the heating effect on the ribbon has some benefit, the reinking can be accomplished without applying heat to the reinked ribbon. Thus, the heat source described herein can be omitted and does not form a part of this invention.

After leaving the heat source, the ribbon is pulled across a driven wheel, or capstan. The rotational speed of the capstan is coordinated with the speed of the inking drum so that the peripheral speed of the capstan is slightly greater than the speed of the drum. In this way, the ribbon will be held taut between the drum and capstan providing constant contact with the drum and heat source.

The ribbon after leaving the drive capstan returns to the cartridge. Since the reloading or rewinding mechanism of the cartridge usually is of a very fragile, economical design, this cartridge mechanism will take very little stress before it will fail or the ribbon will break. Thus, a separate variable speed motor is used solely to drive the ribbon return mechanism in the cartridge for returning the inked ribbon to the cartridge cavity. The reeless ribbon type cartridge disclosed herein, is of the design wherein the ribbon is stuffed or pushed into the cartridge cavity and not rolled on individual spools. Thus, with the variable speed drive for the cartridge mechanism the speed can be easily controlled as necessary to provide a slight tension on the ribbon and yet prevent slack in the ribbon between the drive capstan and the cartridge. In this way, the cartridge mechanism is isolated from the high forces necessary to move the ribbon through the reinking apparatus.

A photoelectric sensor is provided between the drive capstan and the guide roller for the return of the ribbon to the cartridge and is to perform two functions. A small light colored ink dot or mark is applied to the edge of the ribbon at the start of the reinking process. This dot goes through the cartridge and the reinking process to return to the sensor position. The presence of the mark causes the photoelectric sensor to stop the motors and light an indicator signal identifying the completion of the reinking of the ribbon. In addition, a photosensor and light source are also provided to detect holes or imperfections in the reinked ribbon so that if a defect exists the machine will be stopped and a signal will be energized to identify the condition.

In operation, the apparatus and process are extremely simple in that after the cartridge is rigidly mounted the ribbon is carefully drawn from the outlet side and threaded across the elements of the machine. Once the ribbon is in position and marked, the machine is started and the operation continues until the entire ribbon has been reinked. An elapsed timer and various switches are used to sequentially control the process for each operation.

BRIEF DESCRIPTION OF THE DRAWINGS

Other features of this invention will appear in the following description and claims, reference being made to the accompanying drawings forming a part of the specification where like reference characters designate corresponding parts in the several views.

DETAILED DESCRIPTION OF THE EMBODIMENTS

Figure 1:
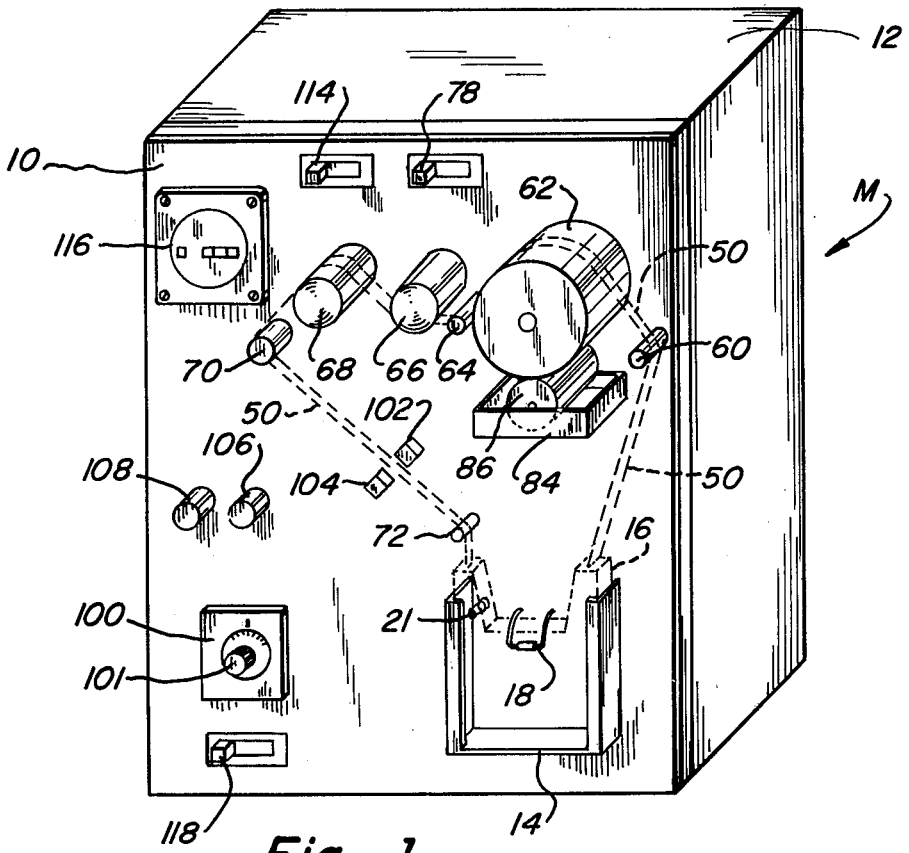
FIG. 1 is a perspective view of the ribbon reinking apparatus according to the present invention.

Turning now more specifically to the drawings, FIG. 1 shows the machine M having a face or mounting plate 10 and protective cover 12. The importance of the cover is to support face plate 10 and prevent contamination of the working mechanism of the components by dust and dirt. A mounting bracket 14 provided in the lower right-hand portion of the front of the mounting plate 10 is used to support the ribbon cartridge 16 in a secure and rigid position. A spring-loaded clip 18 can be provided to clamp the cartridge in proper position. The front extension of the cartridge drive shaft 21 is rotated as the cartridge is mounted in the bracket 14 so that the keyed motor shaft (not shown) engages the opposite end of the shaft 21.

Figure 2:
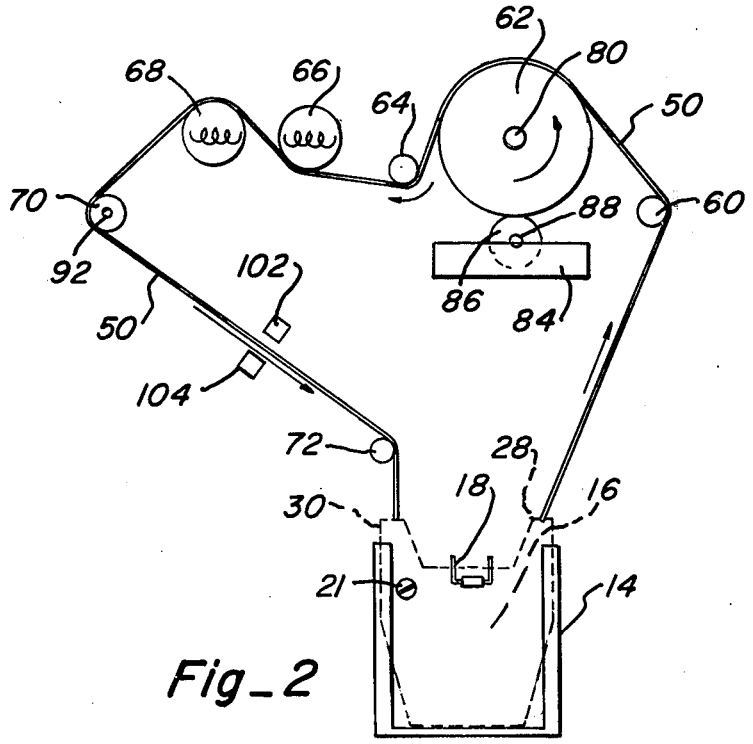
FIG. 2 is a pictorial view showing the relative position of the individual components and the path that the ribbon follows in the reinking process.
Figure 3:
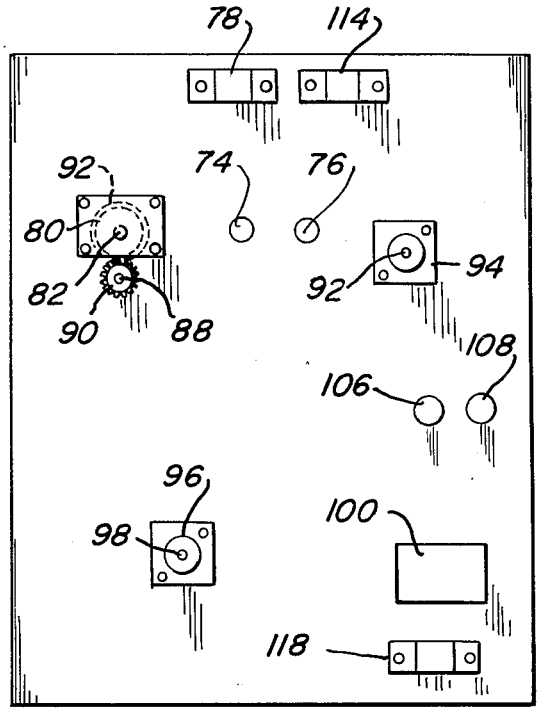
FIG. 3 is a rear-elevation view of the reinking apparatus of the present invention with the case of the apparatus removed to expose the reverse side of the mounted components.
Figure 4:
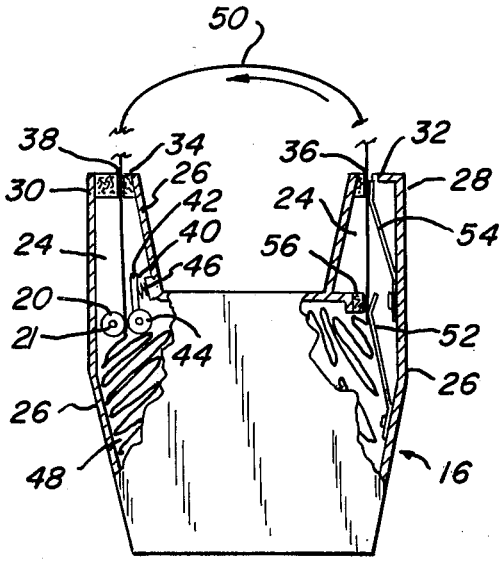
FIG. 4 is a pictorial view of a sectioned cartridge revealing the internal rewind drive mechanism built into the cartridge in addition to the tension devices used to restrain the release of the ribbon from the cartridge.

At this point, it is helpful to have an understanding of the internal structure of the typical ribbon cartridge (see FIG. 2). The cartridge 16 has an outer case having a front 22, back 24 and sides 26. Sometimes outwardly extending appendages or arms 28, 30 are included which have guides 32, 34 and slots 36, 38 respectively. The slots 36 and 38 are thin openings and maintain the ribbon 50 in a flat, straightened condition during its egress from and ingress to the cartridge. The ribbon 50 travels as shown by the arrow from the right arm 28 and is drawn back into the cartridge through the opposite arm 30. Rewind spindle 20 is rigidly attached to shaft 21 which is mounted for rotation in the front and back surfaces of the cartridge 16. As stated above, the back end of the shaft 21 is keyed for attachment to some form of motor drive shaft for rewinding the ribbon into the cartridge. Lever 40 is pivotally mounted at the opposite end. A spring 46 is positioned between the inside surface of the cartridge and the lever arm 40 to constantly bias the idler wheel 44 against the driven rewind spindle 20. The surface of the rewind spindle 20 is coated with a resilient material such as rubber or plastic to provide friction between the ribbon and the spindle to prevent slippage. As the ribbon 50 is drawn out of the right side of the cartridge as viewed in FIG. 4, it passes under a pair of leaf or tension springs 52, 54 which are biased into contact with shoulder 56 and guide 36, respectively. As the ribbon is drawn from and returned to the cartridge, it moves from left to right across the interior cavity 48. The springs 52, 54 keep the ribbon from unravelling and maintains it in a smooth, straight, lightly tensioned condition.

Once the cartridge 16 has been mounted on the bracket 14, the ribbon 50 is drawn from the right arm 28 and threaded around the guide roller 60, across the top of the inking drum 62 and under the guide roller 64. The ribbon then passes under the first heat source 66 and over the second heat source 68 before being guided around the drive capstan 70. The ribbon 50 as it leaves the drive capstan 70 is guided over the guide roller 72 before reentry into the cartridge 16. The heat sources, 66, 68 can be elongated 25 watt incandescent lamps which are fixedly mounted in electrical sockets 74, 76 respectively. Switch 78 mounted on the plate 10 is used to control the operation of the heat source.

Inking drum 62 is mounted on rotating shaft 80 which is driven by motor 82. Ink reservoir 84 and inking wheel 86 are mounted on the front side of the panel 10. The ink wheel 86 is mounted on shaft 88 and is drivingly connected to shaft 80 by a pair of gears 90 and 92. In this way, the inking wheel 86 and drum 62 are directly coupled with the gears properly sized so that the peripheral velocities of the inking wheel and drum are identical. As the drum 62 rotates, the wheel constantly turns in a quantity of ink held in the reservoir 84 with a portion of this ink drawn upward on the surface of the wheel 86 so that it will be evenly transferred to the outer surface of the drum 62. The width of the wheel 86 and drum 62 is designed to be as wide or slightly wider than the widest ribbon anticipated to be reinked. Provision is made for adjusting the inking wheel 86 in relation to the drum 62 so that the contact force between the rotating members can be controlled to vary the thickness of the film of ink deposited on the drum 62.

Drive capstan 70 is mounted on the drive shaft 92 of motor 94. The drive capstan 70 has a body or roller and a shallow outer edge flange for maintaining the ribbon on the roller. The surface of the roller is smooth which allows some slippage with the ribbon to hold the ribbon in a taut condition and in contact with the ink drum 62. The guide rollers 60, 64 and 72 can also have a flange on the outer edge to maintain the ribbon in proper position if desired. A third motor 96 which is of the variable speed type has a drive shaft 98 which includes a keyed socket for engagement with the shaft 21 for driving the cartridge rewind spindle 20. The motor 96 is of the reversible type and includes a variable speed controller 100 which will be described below. The necessity for the reversing capability is due to the fact that not all rewind mechanisms rotate in the same direction to return the ribbon to the cartridge cavity.

In the present invention, motor 96 through its variable speed controller 100 is adjusted to a speed which takes up the reinked ribbon, returns it to the cartridge and eliminates slack between the guide roller 72 and the drive capstan 70.

The drive capstan 70 and inking drum 62 are driven by motors 94 and 82 respectively. These motors are of the constant speed type and are drivingly connected to the shafts of the drive capstan and drum. The rotational velocities for these elements are substantially in inverse proportion to their diameters. Where the inking drum diameter is 4.125 inches and the drive capstan has a diameter of 1.250 inches, a rotational velocity of 104 rpm on the drive capstan and 30 rpm on the ink drum has proven to be satisfactory. The circumferential velocity of the drive capstan, thus, is slightly greater than the circumferential velocity of the drum in order to maintain the inked ribbon in the taut condition across the heat elements 66, 68.

It is to be understood that depending upon the arrangement desired, a single motor can be provided with properly sized drive belts and pulleys for simultaneously rotating the drive capstan and the inking drum. The sizing of the pulleys is important in this embodiment in order to obtain the proper circumferential velocities for the components.

Photoelectric sensors 102 and 104 are positioned on either side of the path of the ribbon 50 as it returns to the cartridge 16. A light colored paint or ink dot is placed on the edge of the ribbon at the beginning of the reinking cycle. Once the continuous ribbon has made a complete path with the ink dot passing in front of the sensor 102, a double pole switch is automatically triggered and disconnects the power to the motors and heat sources and energizes a green light 106 on the front of the panel. A second sensor 104 positioned below the path of the ribbon uses a light source on the opposite side of the ribbon and a photoelectric cell to sense any holes or tears in the ribbon which would cause the ribbon to be rejected. If a defect is discovered, sensor 104 automatically actuates a switch which disconnects the motors and heat sources and lights a red lamp 108 mounted on the front of the panel. The operator in this way can easily tell when the ribbon reinking has been completed or a defect has been found which may require the cartridge to be scraped.

Figure 5:
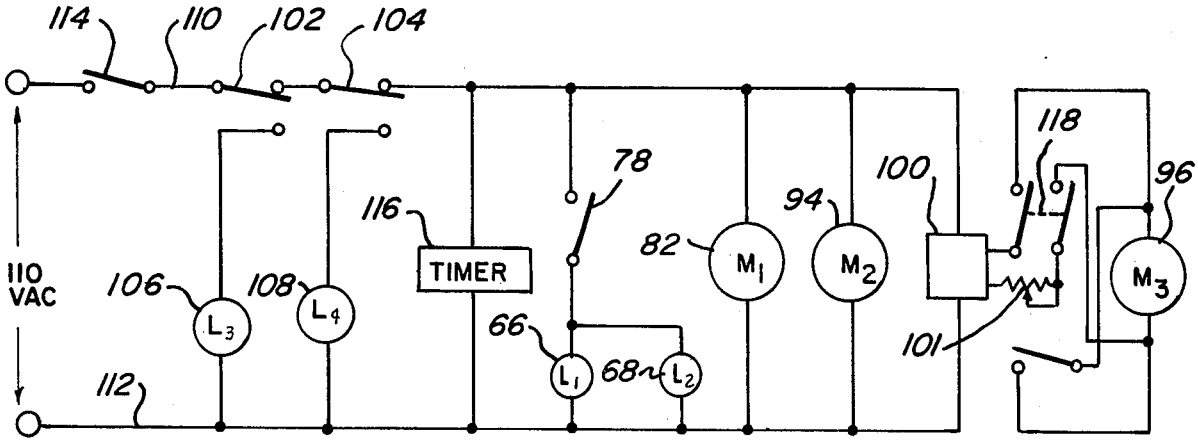
FIG. 5 is a schematic view of the electrical circuit utilized in the operation of the apparatus of the present invention.

In FIG. 5, a schematic of the electrical circuit for the reinking apparatus is shown. The left side of the power busses 110, 112 are connected to a power source such as 110 volts AC. A master switch 114 is provided for controlling power to the overall circuit. The bus 110 is connected to the sensor 102 which includes a double pole, single throw switch with the normally closed side of the switch connected through bus 110. The open contact of the sensor switch 102 is connected through the green light 106 to the bus 112. The defect sensor 104 connected through the bus 110 also includes a double pole, single throw switch with the normally open contact connected through the red indicator light 108 to the bus 112.

An elapsed timer 116, heat source switch 78 and heat source lamps 66, 68, as well as motors 82, 94 and motor controller 100 are connected in parallel across the busses 110, 112. The elapsed timer 116 provides the cumulative time that the machine has been used for reinking of ribbons. The heat source switch 78 is provided so that the lamps can be turned off and on in sequence at the beginning and end of the operation so that the ribbon will not be overheated while the motors are idle. The motor controller 100 includes a variable resistor 101 which controls the speed of motor 96 from zero to maximum speed as necessary to take up the slack in the ribbon returning to the cartridge.

As can be seen, the operation of the machine is automatic once the ribbon cartridge has been mounted and the ribbon properly threaded. Energizing the master switch 114 starts all three motors simultaneously. Engaging switch 78 lights the heat lamps 66, 68 which produces the heat to set the ink in the ribbon. Switch 118 is turned to the proper position for the rewind rotation for the particular cartridge being serviced. With the light colored ink dot applied to the ribbon at the beginning of its cycle, the operation of the machine is continuous and automatic through the sequence until the cycle has been completed and the ink dot again passes in front of the sensor 102. At this point, the power to the circuit is disconnected with the green light 106 lit indicating completion of the cycle. The master switch 114 is then disengaged and the completed cartridge is removed and replaced by another used cartridge. The ribbon is threaded and the ink dot is applied with the master switch 114 again engaged. This action automatically resets the sensor 102 and starts the reinking sequence. It is to be understood that the cartridge mounting bracket 14 can be easily replaced with other brackets to accommodate various sizes and shapes of cartridges.

While a process and apparatus for reinking cartridge ribbons has been shown and described in detail, it is obvious that this invention is not to be considered as being limited to the exact form disclosed, and that changes in detail and construction may be made therein within the scope of the invention without departing from the spirit thereof.

What is claimed is:

1. A method for reinking endless typing ribbons stored within a cartridge which includes the steps of a. positioning and mounting the cartridge in suitable position for reinking the ribbon,
b. threading the ribbon from the cartridge partially around and in contact with an ink applying drum located exteriorly of the cartridge,
c. guiding the ribbon around a driven capstan,
d. returning the ribbon to the cartridge through its reloading mechanisms for storage, and
e. rotating independently the ink drum, the driven capstan and the cartridge ribbon reloading mechanism so that the cartridge is essentially isolated from the ribbon reinking so that minimum stress is placed on the cartridge ribbon reloading mechanism to prevent damage and breakage to the cartridge and ribbon.

2. A method for reinking cartridge type ribbons as described in claim 1 which further includes the step of rotating the drive capstan at a slightly greater circumferential velocity than the circumferential velocity of the ink drum so that the ribbon is pulled taut across the drum during reinking.

3. A method for reinking cartridge type ribbons as described in claim 1 which includes the step of a. inspecting the reinked ribbon for completion of the reinking process and for defects in the ribbon prior to being returned to the cartridge, and b. said inspection step further includes the stopping of the movement of the ribbon when either the reinking process is completed or a defect is found in the ribbon.

4. An apparatus for reinking used typing ribbons which comprises a. support means for mounting components in a generally planar arrangement, b. inking means mounted on said support means for reinking the typing ribbon, said inking means having a rotatably mounted independently driven ink drum the surface of which transfers a film of ink to said ribbon, and c. a plurality of drive means mounted on said support means for moving the ribbon over the inking means for transferring ink to said ribbon, said plurality of drive means includes (1) a first drive means drivingly connected to said ink drum for rotating said drum at a constant circumferential velocity, and (2) a second drive means independent of said first drive means and drivingly connected to and including a ribbon drive capstan, said second drive means being arranged to rotatably drive said capstan at a circumferential velocity which is slightly greater than the circumferential velocity of said ink drum whereby the ribbon is maintained in a taut condition.

5. A ribbon reinking apparatus as defined in claim 4 wherein a third drive means independent of said first and said second drive means mounted on said support means is arranged for collecting the inked ribbon, said third drive means includes a variable speed motor having means for manually changing the speed of said third drive means as the ribbon moves across the ink drum so that the ribbon can be collected at the proper speed without applying stress to the ribbon.

6. A ribbon reinking apparatus as defined in claim 5 wherein a. the used ribbon is stored within a cartridge and said cartridge is removably mounted on said support means during reinking, and b. the ribbon is threaded from said cartridge over the inking drum and said drive capstan before returning to said cartridge, said cartridge includes a reloading mechanism which is driven by the third independent drive means whereby the ribbon can be returned to the cartridge without placing stress upon the cartridge or ribbon.

7. An apparatus for reinking used typing ribbons stored in cartridges, said cartridge having a reloading mechanism for returning the ribbon to the interior of the cartridge, the apparatus comprises a. support means for holding components in a generally planar configuration;

b. mounting means for removably mounting a cartridge on said support means, c. ink means mounted on said support means for dispensing ink to the ribbon, said ink means having a rotatable independently driven inking drum and located exteriorly of the cartridge and a source of ink which is applied to the surface of the drum for transfer to the ribbon as the drum rotates.

d. pull means having a ribbon drive capstan rotatably mounted on said support means and a first independent motor means for rotating said capstan so that the ribbon from the cartridge will be moved across said inking drum and held taut, and e. a second motor means independent of said first motor means and drivingly connected to the cartridge reloading mechanism, said second motor means having means for varying the speed of the motor means whereby the reloading mechanism can be operated at the proper speed so that the ribbon can be returned to the cartridge without placing stress upon the cartridge or ribbon.

* * * * *